United States Patent [19]

Gibbs

[11] 4,446,793

[45] May 8, 1984

[54] DISK DEPLOYMENT OF EXPENDABLES

[76] Inventor: Robert L. Gibbs, 161 Larkwood Cir., San Ramon, Calif. 94583

[21] Appl. No.: 334,597

[22] Filed: Dec. 28, 1981

[51] Int. Cl.[3] ..... F42B 13/42

[52] U.S. Cl. ..... 102/505; 89/1.5 R; 343/18 E; 102/359

[58] Field of Search ..... 102/505, 359, 340, 342, 102/351, 357; 89/1.5 R, 1.819, 1.808; 343/18 B, 18 E

[56] References Cited

U.S. PATENT DOCUMENTS

| | | | |
|---|---|---|---|
| 1,420,072 | 6/1922 | Aronson | 102/359 X |
| 3,027,047 | 3/1962 | Johnson | 102/505 X |
| 3,095,814 | 7/1963 | Jansen et al. | 102/505 X |
| 3,137,231 | 6/1964 | Johnson | 102/351 |
| 3,143,965 | 8/1964 | La Pointe | 102/351 |
| 3,674,174 | 7/1972 | Crewe | 102/505 X |
| 3,741,125 | 6/1973 | La Pointe | 102/505 |
| 3,765,336 | 10/1973 | Kulsik | 102/505 |
| 3,898,661 | 8/1975 | Kelly et al. | 102/505 X |
| 4,175,469 | 11/1979 | Ritland et al. | 102/505 X |
| 4,178,854 | 12/1979 | Schillreff | 102/505 X |
| 4,183,302 | 1/1980 | Schillreff | 102/505 X |
| 4,333,402 | 6/1982 | Landstrom et al. | 102/505 |

OTHER PUBLICATIONS

"Exploratory Development of Disk Developed Chaff" Proposal MTS Nov. 1981, MT Systems, Inc.

*Primary Examiner*—David H. Brown

[57] ABSTRACT

A spin stabilized disk for deploying chaff (radar countermeasure dipoles) or other expendable materials or substances from a moving aircraft. The disk, containing the expendable material is ejected from the aircraft at an angle in azimuth off of the aircraft line-of-flight and dispenses the expendable material in a more or less uniform fashion for a brief period of time as it travels away from the aircraft.

3 Claims, 5 Drawing Figures

FIG. 3
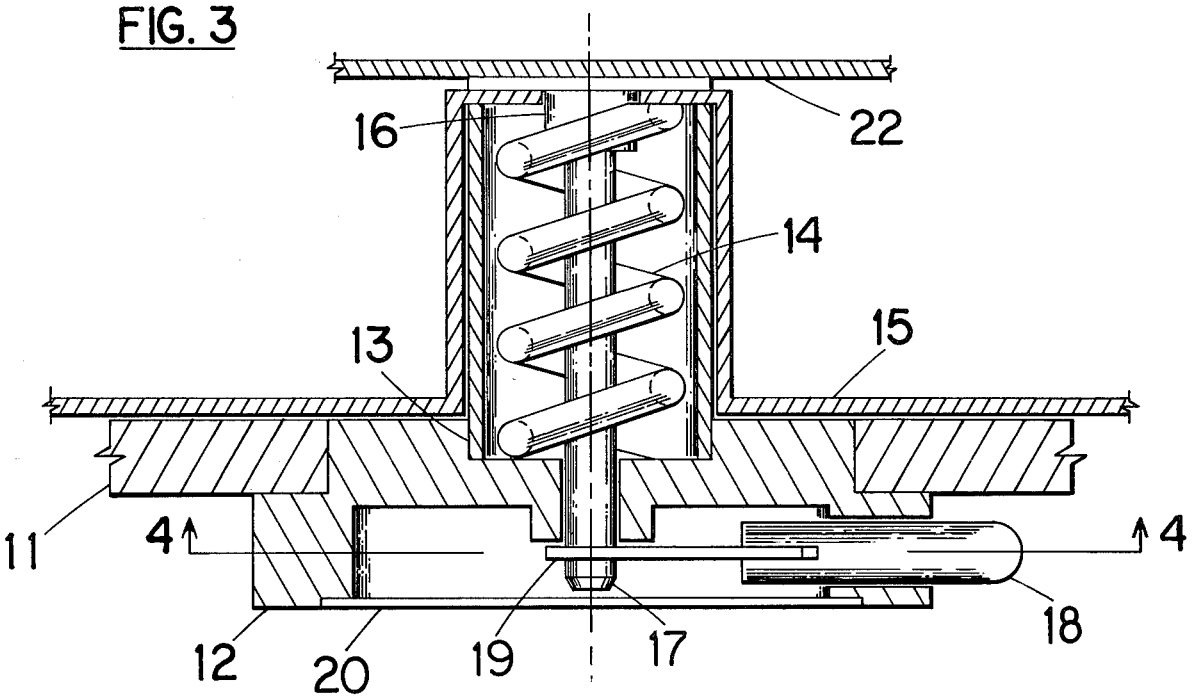
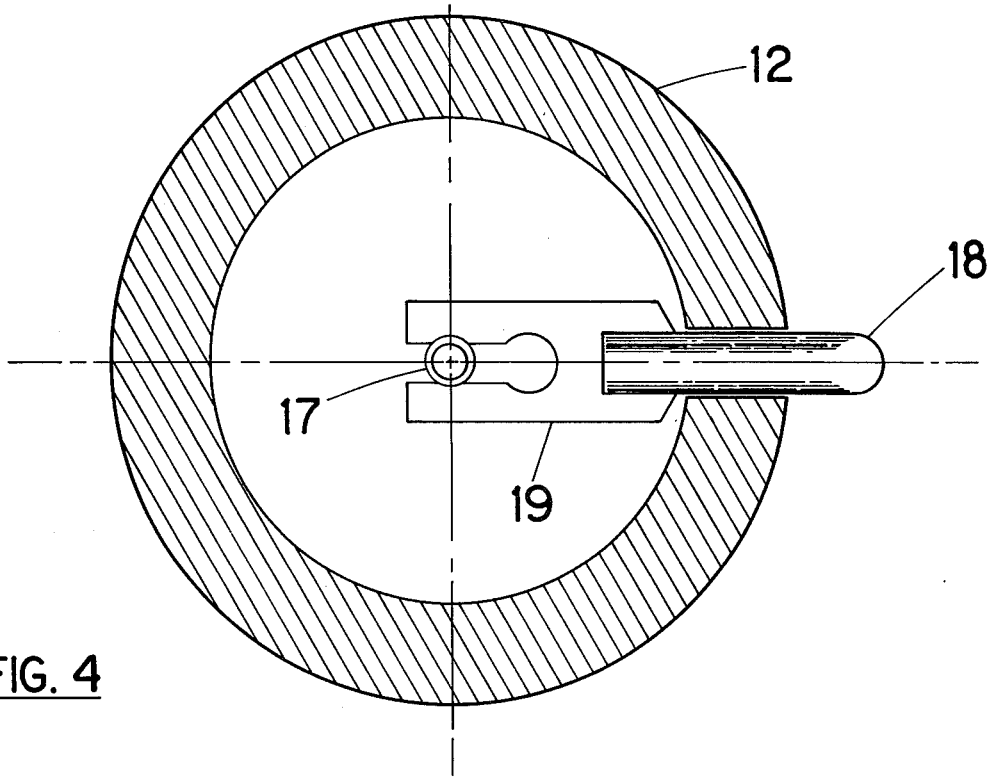
FIG. 4

DISK DEPLOYMENT OF EXPENDABLES

FIELD OF INVENTION

This invention relates to the field of passive electronic countermeasures and specifically to a new method of deploying expendable materials such as chaff from a moving aircraft.

DISCUSSION OF THE PRIOR ART

Heretofore, chaff has been deployed from moving aircraft by one of the following five methods:

(a) Near instantaneous ejection of a clump(s) of dipoles into the adjacent airstream by pyrotechnic or pneumatic means.

(b) Ejecting the contents of a box of chaff by mechanically tearing open the box in the presence of ram air which is exhausted outside of the aircraft or external store structure.

(c) Releasing dipoles into a ram air environment from between two layers of film of synthetic resin composition. The chaff package is stored under tension in roll form and as the roll is mechanically unwound, the dipoles are released from between the film layers into the ram air stream for ejection into the boundary layer of the aircraft or external store.

(d) Dipoles may be released from a forward-fired rocket in one or more bursts at some distance ahead of the aircraft and at a predetermined intervals as applicable. Individual bursts occur nearly instantaneously and are pyrotechnically actuated.

(e) By bullet fired from an on-board gun. Chaff contained in the bullet is conveyed to a point some 3,000 to 5,000 feet from the aircraft and released.

Regardless of release method utilized, dipoles tend to stop their forward progress very rapidly once released to the air stream due to their low mass and relatively high drag. For said methods (a) and (b) this results in a small chaff cloud forming well aft of the rapidly moving aircraft. For said method (c) the dipole stream is continuous but does not reach significant width and height dimensions for some distance aft of the aircraft. This method normally requires use of an external stores station. Forward fired rockets, said method (d), can seed chaff clouds ahead of the aircraft which may grow to significant size by the time the aircraft and chaff cloud share the same radar resolution cell and may therefore be effective. This method is very costly, however, and also requires the use of an otherwise valuable external stores station for the rocket launcher pod and delays aircraft maneuvers after launch of the rocket. Method (e) releases the chaff too far from the aircraft to be effective.

For an aircraft on a radial run against a threat radar system, the chaff clouds of said methods (a) through (e) do not have sufficient size (cross section) while in the vicinity of the aircraft to provide protection for the aircraft. By ejecting a spinning disk device at some angle off the aircraft line-of-flight (90° for example) and releasing dipoles from the disk as it moves outward, a significant increase in cloud size while still in the vicinity of the launching aircraft will be achieved.

Prior art provides the means of ejecting a disk at the proper velocity relative to the aircraft and at the proper spin rate to achieve aerodynamic stability. This invention deals with a means of releasing dipoles or other material from the disk on a more or less uniform basis for a short period of time on the order of 0.5 seconds.

The following patents are cited as the most pertinent prior art of which the applicant is aware.

| U.S. Pat. No. | Name | Date |
|---|---|---|
| 3,027,047 | F. M. Johnson | 3-27-62 |
| 3,137,231 | F. M. Johnson | 6-16-64 |
| 3,765,336 | R. J. Kulsik | 10-16-73 |
| 4,178,854 | G. H. Schillreff | 12-18-79 |
| 4,183,302 | G. H. Schillreff | 1-15-80 |

OBJECTS

Accordingly, several objects of this invention are:

(a) To provide an expendable disk for the distribution of microwave or optically reflective materials in the near vicinity of an aircraft.

(b) To provide a means of arraying chaff or other materials in an outward direction from an aircraft line-of-flight.

(c) To provide a means of dipole or other type material release at a more-or-less uniform rate for a short period of time as the disk separates from the aircraft.

Further objects and advantages of this invention will become apparent from a consideration of the drawings and ensuing description thereof.

BRIEF DESCRIPTION OF DRAWINGS

FIG. 3 is an enlarged fragmentary view of the central portion of FIG. 2.

FIG. 4 is a cross-sectional view taken along line 4—4 of FIG. 3.

DESCRIPTION OF INVENTION

Figure 1:
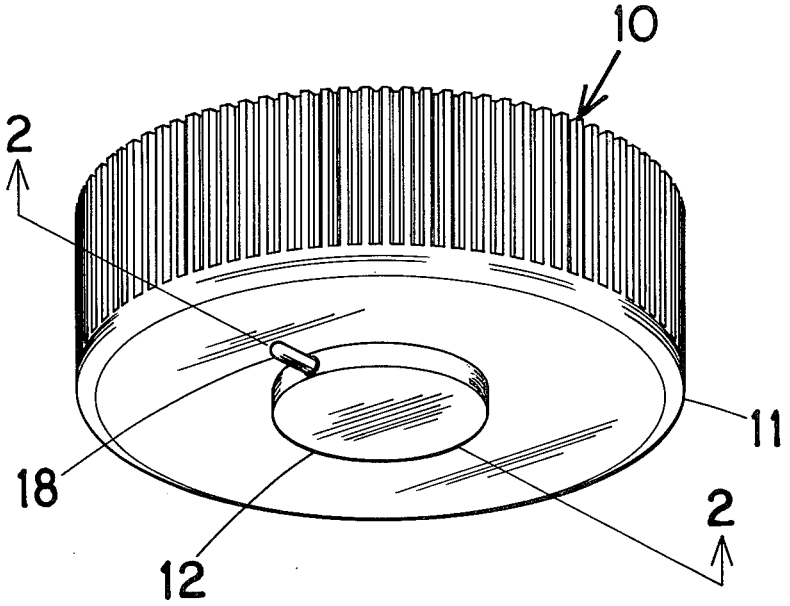
FIG. 1 is a perspective view depicting one embodiment of the present invention.

In a preferred embodiment thereof the disk 10 is shown in FIG. 1 comprises a disk case 11, a release pin 18 and a bushing 12 which supports the internal payload and release assembly. The disk case 11 is made of plastic or metallic material and has spur gear teeth located completely around the periphery. The inside circumferential surface of the case 11 is tapered so that the inside diameter of the top of the case 11 is greater than the inside diameter at the bottom of the case 11.

Figure 2:
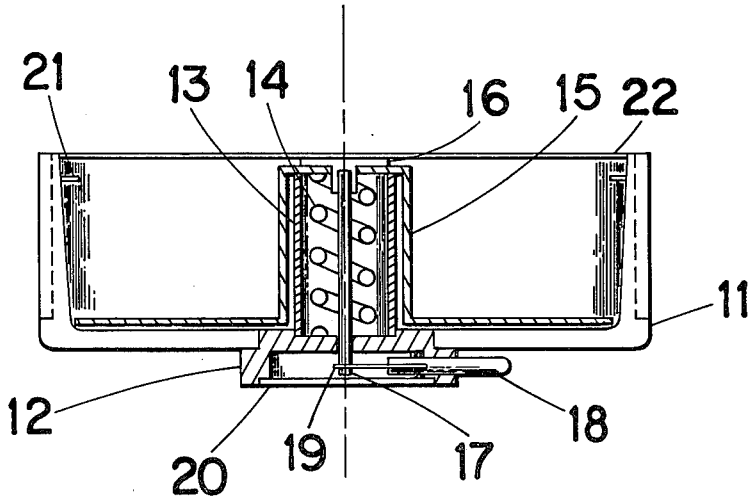
FIG. 2 is a cross-sectional view taken along line 2—2 of FIG. 1.

FIG. 2 shows a cross-sectional view of the disk 10. The bushing 12 is press fit or bonded to the case 11. The tube 13 is press fit or bonded to the bushing 12. The payload tray 15 comprises a tubular center section with a small disk with a small center hole on top and a disk on the lower end of a diameter slightly less than that of the case 11 inside diameter at its base. The small center hole in the top disk part of the payload tray 15 is of such size as to permit insertion of the lower section of the retainer 16. The opening in the tubular portion of the payload tray 15 is slightly greater than the outside diameter of the tube 13 so as to provide free upward or rotational movement of the payload tray 15 relative to the tube 13. Downward position of the payload tray 15 is reached when its top disk portion bottoms on the upper end of the tube 13. The inside diameter opening of the tubular portion of the payload tray 15 is carried through its lower end disk. The payload tray 15 may be a molded plastic part, a dip brazed assembly of aluminum sections or a bonded assembly of plastic sections.

FIG. 3 and FIG. 4 show an enlarged view of the central release assembly area. The retainer 16 and shaft 17 are attached by means of a threaded interface provision. The release pin 18 and the clip 19 are permanently bonded together before assembly of the disk 10. The clip 19 slides in a groove positioned near the lower end of the shaft 17 during assembly and retains the spring 14 in a compressed position. The closure seal 20 is bonded or press fit into the bushing 12 after assembly. The retaining pin 21, FIG. 2, is of small diameter steel wire and four such pins are inserted into the case spaced equidistantly around the circumference after the payload tray 15 has been placed into the case 11. The chaff dipoles or other payload material is placed inside of the case 11 and around and on top of the payload tray 15. A top cover 22 is located flush with the upper plane of the case and is bonded to the retainer 16 as the last step in assembly of the disk 10.

Figure 5:
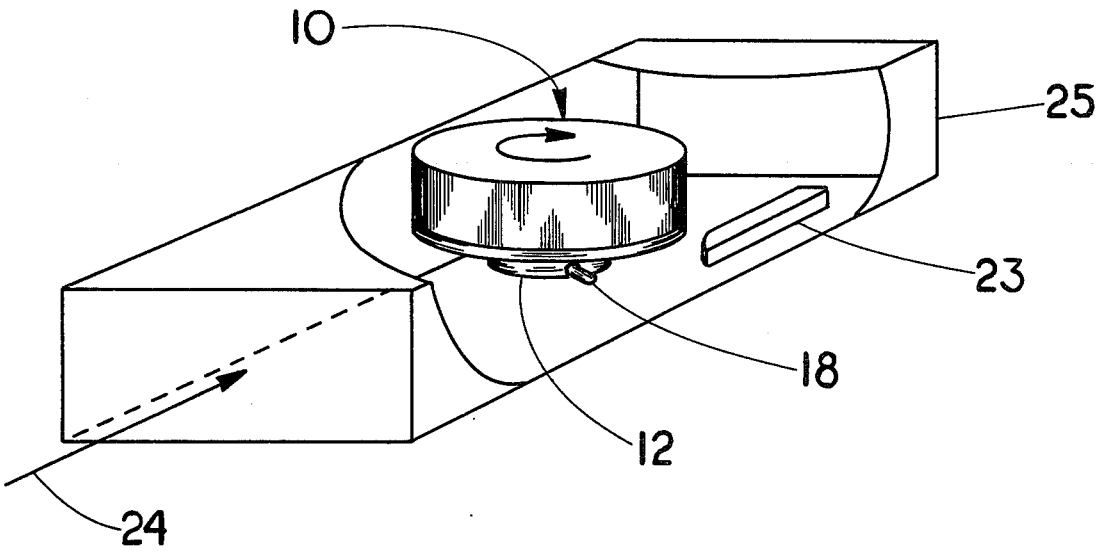
FIG. 5 is a partial view of a launcher rectangular barrel containing a disk.

FIG. 5 shows a partial view of a launcher rectangular barrel 25. A disk 10 is shown in static position and loosely constrained by the upper, lower and far side interior surfaces of the barrel 25. The cut away near side of the barrel 25 contains a rack segment (not shown) which is positioned to engage the circumferential teeth of the disk 10. Upon application of the linear launching force 24 acting on the disk 10, the disk 10 rapidly accelerates toward the far end of the barrel 25 and simultaneously accelerates rotationally due to the forces transmitted through the mating teeth. A depressor element 23 is fastened to the lower inner surface of the barrel 25 which permits the disk 10 to pass but is located sufficiently close to the bushing 12 to depress the pin 18 as the disk 10 is ejected from the barrel 25.

OPERATION OF INVENTION

In operation the disk 10 is launched from a device not covered by this invention. This device accelerates the disk through a barrel 25 of rectangular cross section. The approximate width and height of the barrel is that of the diameter and height of the disk. Barrel width is adjusted to provide for a spur gear rack segment means down one side. As the disk is accelerated through the barrel 25 it is spun up to an ejection rate of approximately 4,000 RPM. When launched from an aircraft flying at subsonic attack speeds the disk is initially exposed to air velocities of 800 to 900 feet per second. When launched from slower flying aircraft or helicopters this initial wind velocity exposure can be as low as 200 to 300 feet per second. Approximately horizontal launch is considered normal off to either side of the aircraft.

During the last part of travel down the launcher barrel 25, a small depressor element 23 fastened to the lower plate of the barrel 25, depresses release pin 18 on the disk 10. This action permits the spring 14 to begin raising the payload at the instant that the disk 10 clears the exit plane of the barrel 25. In addition to the payload, consisting of various length horizontally oriented radar dipoles in the preferred embodiment, the following parts of the disk 10 are raised with the payload relative to the case 11 and its attachments: the payload tray 15, the shaft 17, the retainer 16 and the top cover 22. The rate of rise is dependent upon the spring 14 characteristics, the weight of the moving mass, the exposed wind velocity and the clearance between the inside diameter of the tubular center section of the payload tray 15 and the outside diameter of the fixed tube 13. As the spinning disk 10 advances outward from the aircraft the payload elements are exposed in successive layers to the air stream travelling between the top cover 22 and the case 11 upper edge which tends to peel dipoles off to the outside air. An addition force tends to release dipoles and that is the centrifugal force which in conjunction with the tapered inner peripheral surface of the case 11 pushes the payload elements toward the opening between the top cover 22 and the upper edge of case 11. The payload tray 15 is prevented from leaving the case 11 by the retaining pins 21. The total time required to release the payload is approximately 0.5 seconds in the preferred embodiment.

For some combinations of payload type, initial airspeed exposure, initial disk spin rate and desired length of time for payload release, it is possible to eliminate the payload tray 15 and to raise or completely release the top cover 22 to effect dispersion of the payload. In these instances, the centrifugal forces and the lower pressures on top of the payload due to high velocity air passage combine to eject the payload material from the disk case 11.

BROADENING PARAGRAPH

While the above description contains many specificities, these should not be construed as limitations on the scope of the invention, but rather as an exemplification of one preferred embodiment thereof. Many variations are possible, for example wrapping groups of dipoles in mylar strips before loading; using string ball dipoles for the payload; use of aerosol payloads; use of retroreflective devices for the payload, all with modifications to the payload release mechanism as appropriate. In addition this invention may be ejected from surface vehicles such as tanks. Accordingly, the scope of the invention should be determined not by the embodiment illustrated, but by the appended claims and their legal equivalents.

I claim:

1. A spin stabilized disk, rotating about an axis which is initially perpendicular to the line-of-travel of the said disk while releasing a payload of radiation interference material as said disk proceeds away from a launcher device comprising: a disk case substantially closed at one end and containing a gear teeth means around all or a part of its external circumferential surface to provide for the input of rotational forces to said disk during its launch, an internal cavity in the said disk case for storing the said payload, a disk closure for the open end of said disk which contains the said payload until the instant of launch, a release mechanism means for the release of said disk closure immediately upon egress of said disk from its launching device.

2. The disk of claim 1 wherein the egress of the said payload from the said disk case is assisted by a spring loaded payload tray slideably mounted within said disk disk case which exerts a force on the said payload in the direction of the open end of the said disk case when released by said release mechanism means immediately upon egress of said disk from its launching device.

3. The disk of claim 1 wherein the said disk case has internal tapered circumferential walls to aid in said payload egress from said disk case where the inside diameter of the said disk case increases as its open end is approached wherein centrifugal forces acting on elements of said payload combine with said tapered walls to direct said payload elements toward the open end of the said disk case.

* * * * *